US007070130B1

(12) United States Patent
Minko

(10) Patent No.: US 7,070,130 B1
(45) Date of Patent: Jul. 4, 2006

(54) ROTATABLE ELECTRODE RING AND USE THEREOF IN ELECTROSTATICALLY ASSISTED HIGH-SPEED ROTARY APPLICATION OF SPRAY COATING AGENTS

(75) Inventor: Peter Minko, Schwelm (DE)

(73) Assignee: E. I. duPont de Nemours and Company, Wilmington, DE (US)

( * ) Notice: Subject to any disclaimer, the term of this patent is extended or adjusted under 35 U.S.C. 154(b) by 328 days.

(21) Appl. No.: 10/632,784

(22) Filed: Aug. 1, 2003

Related U.S. Application Data

(60) Provisional application No. 60/424,202, filed on Nov. 6, 2002.

(51) Int. Cl.
*B05B 5/00* (2006.01)
*F23D 11/32* (2006.01)

(52) U.S. Cl. ..... 239/690.1; 239/700; 239/691; 239/222.11; 239/223

(58) Field of Classification Search ..... 239/690.1, 239/700
See application file for complete search history.

(56) References Cited

U.S. PATENT DOCUMENTS

| | | | | |
|---|---|---|---|---|
| 4,887,770 | A * | 12/1989 | Wacker et al. | 239/703 |
| 6,352,589 | B1 * | 3/2002 | Furuoya | 118/300 |
| 6,439,485 | B1 * | 8/2002 | Borner | 239/706 |
| 6,672,521 | B1 * | 1/2004 | Reichler | 239/703 |
| 6,896,735 | B1 * | 5/2005 | Giuliano et al. | 118/629 |
| 2002/0096582 | A1 * | 7/2002 | Edelhauser | 239/700 |
| 2003/0001031 | A1 * | 1/2003 | Heldt et al. | 239/700 |

OTHER PUBLICATIONS

Dr. Thomas Brock, European Coatings Handbook, Curt R. Vincentz Verlag, Hannover 2000, p. 295, line 27-28.*
Dr. Thomas Brock, European Coatings Handbook, Curt R. Vincentz Verlag, Hannover 2000, p. 294 to 296.

* cited by examiner

*Primary Examiner*—David A. Scherbel
*Assistant Examiner*—James S. Hogan
(74) *Attorney, Agent, or Firm*—Steven C. Benjamin

(57) ABSTRACT

An electrode ring suitable for providing electrostatic assistance to the high-speed rotary application of spray coatings and having electrode fingers comprising electrode tips, wherein the electrode ring is constructed so as to be capable of performing rotational movements about the axis directed through the center of the circle thereof.

8 Claims, 2 Drawing Sheets

ROTATABLE ELECTRODE RING AND USE THEREOF IN ELECTROSTATICALLY ASSISTED HIGH-SPEED ROTARY APPLICATION OF SPRAY COATING AGENTS

PRIORITY

This application claims priority from Provisional U.S. Patent Application Ser. No. 60/424,202, filed Nov. 6, 2002, incorporated herein by reference.

FIELD OF THE INVENTION

The invention relates to an electrode ring which may be set in rotational movements and to the use thereof in electrostatically assisted high-speed rotary application of spray coating agents (hereinafter also called spray coatings for simplicity's sake).

BACKGROUND OF THE INVENTION

In industrial original coating, for example, in automotive original coating, spray coatings are widely applied by means of electrostatically assisted high-speed rotary application. In high-speed rotary application, the spray coating supplied to the high-speed rotary bell is merely finely dispersed when it reaches the spray edge of the bell in the case of powder coatings, while it is finely atomized in the case of liquid coatings and in each case sprayed in the direction of the object to be coated. Electrostatic assistance of high-speed rotary application means that the spray mist formed from the liquid coating or the powder coating cloud formed from the powder coating is electrically charged by ion attachment in an electric field with a high field strength and directed in this manner towards the grounded object to be coated. The aim of electrostatic assistance is to reduce the overspray rate or to increase the efficiency of application of the spray coating.

While, when applying non-aqueous liquid spray coatings, the coating droplets may be electrostatically charged directly via the high-speed rotary bell to which a high voltage is applied (contact charging), it is conventional, in particular, when applying aqueous coatings by means of high-speed rotary application to effect electrostatic charging not by contact charging but instead by means of external charging, so-called "corona" charging. In this case, the high-speed rotary bell is grounded and is located in the center of an electrode ring which is firmly fixed therearound and is connected therewith, for example, by screw fixing to the bell housing, the high-voltage electrodes of which ring effect external charging of the spray mist produced by the high-speed rotary bell. The electrode ring surrounds the high-speed rotary bell, which is arranged centrally in its middle, wherein the electrode fingers point in a circular arrangement away from the electrode ring in the direction of spraying. During application, the high-speed rotary bell rotates at high-speed, resulting in the atomization of the liquid spray coating supplied thereto at the spray edge of the high-speed rotary bell to yield fine coating droplets. After leaving the high-speed rotary bell, the coating droplets are charged by means of the electrical field produced in front of the electrodes pointing in the direction of the object to be coated. During application, the rotating high-speed rotary bell, together with the electrode ring firmly fixed therearound, is guided over the surface of the object to be coated by means of a programmed automatic motion apparatus, for example, automated or robotic coating equipment (compare T. Brock, European Coatings Handbook, Curt R. Vincentz Verlag, Hannover, 2000, page 294 to 296).

SUMMARY OF THE INVENTION

Surprisingly, it has proved possible to achieve more uniform coating (more homogeneous distribution of coating thickness, more homogeneous flow, better appearance) together with reduced soiling of the electrodes of the electrode ring as well as greater efficiency of application (less overspray), if, at variance with the above-stated prior art, instead of an electrode ring firmly fixed around the high-speed rotary bell, an electrode ring is used which performs rotational movements about a common axis with the axis of rotation of the high-speed rotary bell.

The present invention accordingly provides a per se conventional electrode ring, known to the person skilled in the art, suitable for providing electrostatic assistance to the high-speed rotary application of spray coatings, wherein, at variance with the prior art, the electrode ring is constructed so as to be capable of performing rotational movements about an axis directed through the center of the circle thereof. In other words, the electrode ring comprises means which are suited to causing it to be set or to setting it in rotational movements about an axis directed through the center of the circle thereof, such that during high-speed rotary application of spray coating the electrode ring can rotate or oscillate in rotational manner.

The present invention also provides a process for coating substrates by means of electrostatically assisted high-speed rotary application of spray coatings, wherein the electrode ring used for external electrostatic charging of the spray mist performs one or more different and successive rotational movements about the common axis of rotation with the high-speed rotary bell, for example, rotational movements, oscillatory movements or sequences thereof.

BRIEF DESCRIPTION OF THE DRAWING

FIG. 1 is not only a representation of an arrangement as described in the previous paragraph, but also represents an arrangement of high-speed rotary bell (1) and electrode ring (3) in the embodiment according to the invention of FIG. 2.

DETAILED DESCRIPTION OF THE EMBODIMENTS

Figure 1:
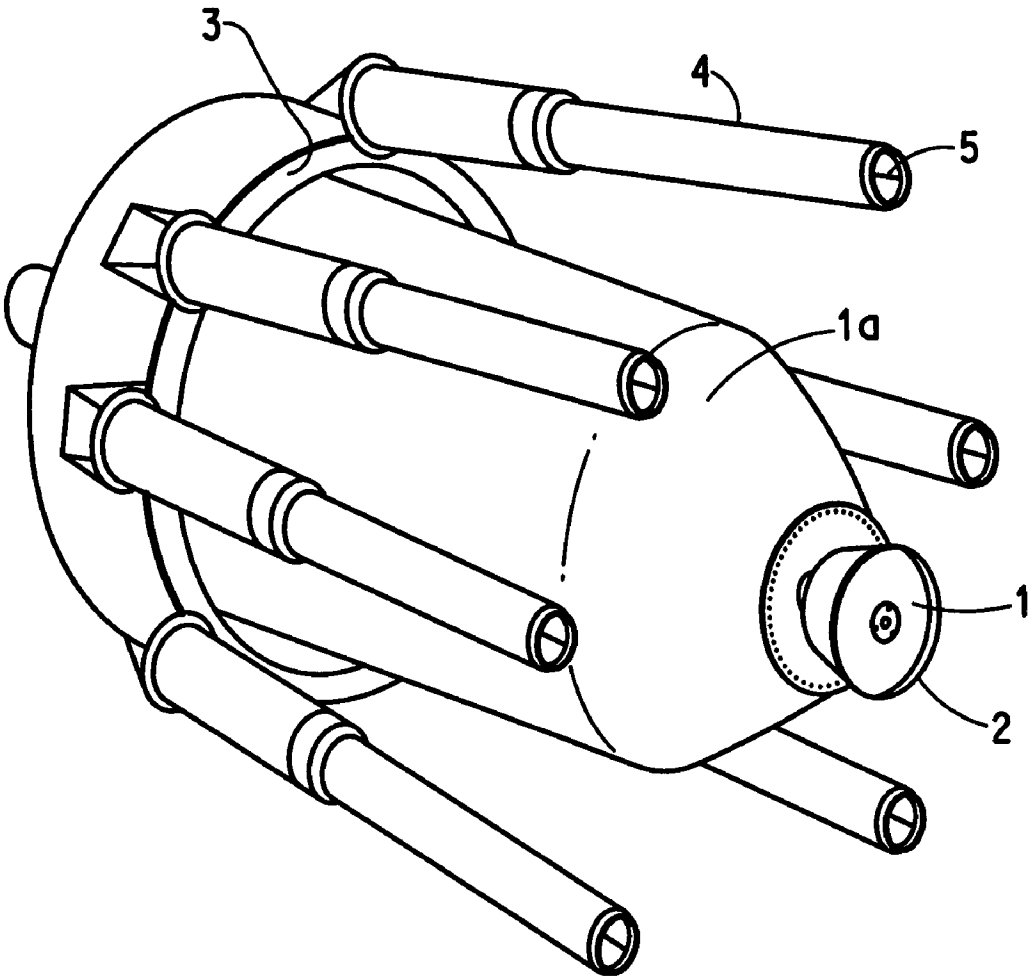
FIG. 1 shows a schematic representation of a typical arrangement of high-speed rotary bell (1) with bell housing (1*a*), spray edge (2) and electrode ring (3) with electrode fingers (4) and electrode tips (5), as described above and according to the prior art.
Figure 2:
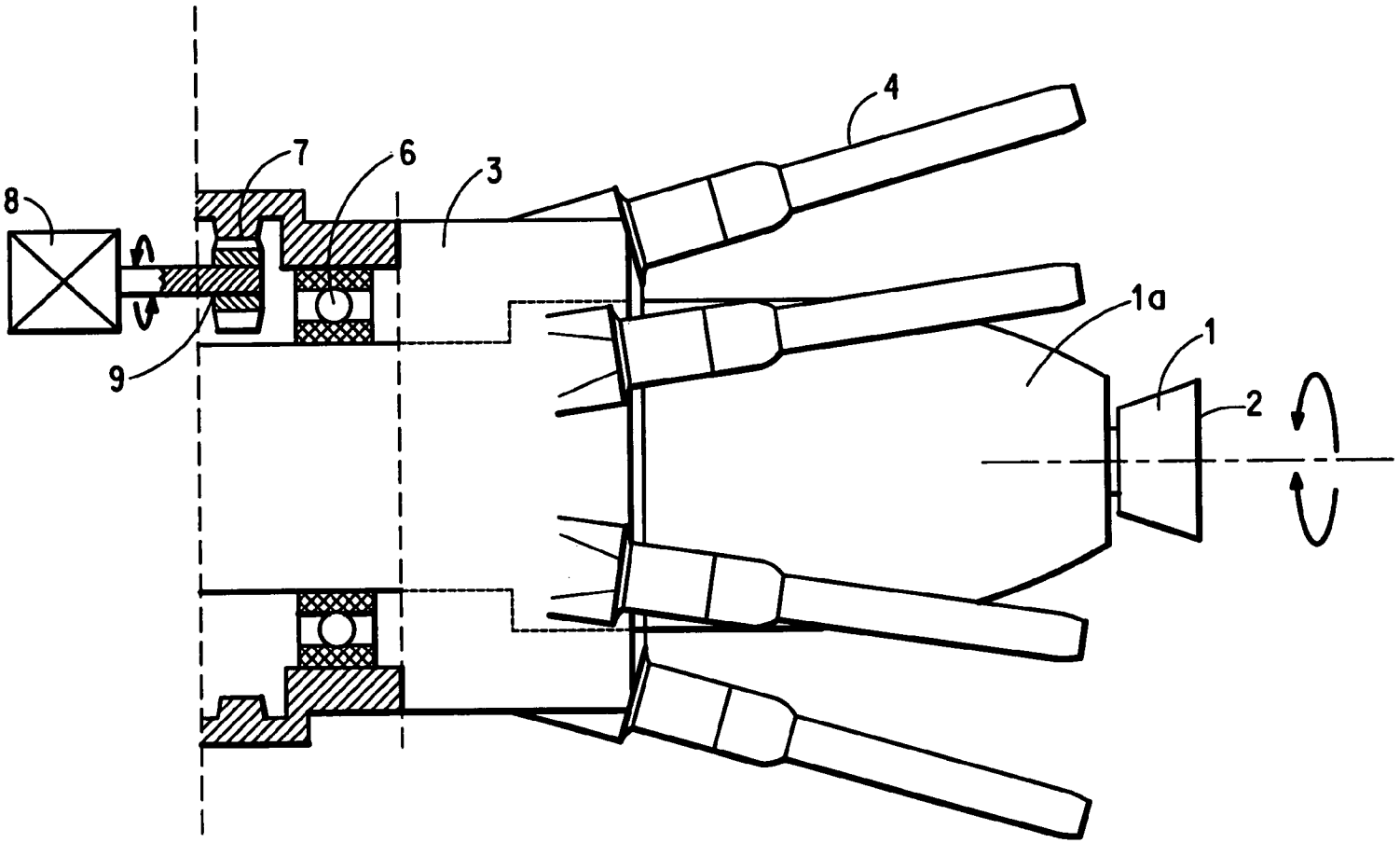
FIG. 2 shows a schematic, partially longitudinal section of one embodiment of an electrode ring (3) according to the invention which is firmly connected with the housing of a high-speed rotary bell (1) via an annular ball bearing (6) arranged between the inside of the electrode ring and the outside of the housing (1*a*) of the high-speed rotary bell (1), but is consequently permitted to move rotationally in both directions of rotation (as shown by the two large arrows) around the axis of rotation of the high-speed rotary bell. The inside of the electrode ring (3) comprises a toothed ring (7), by means of which the electrode ring (3) may be set in rotational movement in both directions of rotation (as shown by the two small arrows) by means of a gear transmission (9) drivable by means of a motor (8). When observed from the outside, the arrangement of high-speed rotary bell (1) and electrode ring (3) according to the invention as shown in FIG. 2 does not differ from the arrangement in FIG. 1. In this respect.

The electrode ring (3) is not made in a single piece, but instead consists of a fastening device, (hereinafter also referred to as fastening ring), firmly connectable with the housing of the high-speed rotary bell (1) which is connected with the actual electrode ring (3) (hereinafter also referred to only as electrode ring for simplicity's sake) by means of a bearing connection. The bearing connection may here simultaneously perform the function of the fastening device or may be the fastening device or a part thereof. The bearing connection may, for example, consist of a ball bearing, a roller bearing, a plain bearing or an air bearing.

The fastening ring may be connected in any desired firmly fixed manner with the housing (1*a*) of the high-speed rotary bell, for example, by screw fastening, clamping (flange joint) or by seating the fastening ring in the bell housing. The fastening ring is fastened in such a manner that the electrode ring (3) and high-speed rotary bell (1) assume the conventional arrangement as in the prior art described above, namely, aligned in such a manner that the electrode ring (3) surrounds the high-speed rotary bell (1) located in the center thereof in annular manner, wherein the high-speed rotary bell (1) and electrode fingers (4) of the electrode ring point in the same direction, namely towards a substrate to be spray coated.

The structure of the actual electrode ring (3) is in principle no different from that of conventional electrode rings known to the person skilled in the art. It has two or more, for example 3 to 8, preferably 4 to 6, electrode fingers (4) uniformly spaced apart in a circle, to the tips (5) of which electrodes, which are directed in the spraying direction, can be applied a high voltage. Electrical contacting of the electrode tips (5) may in particular be achieved, for example, via a direct sliding contact, for example, in the form of a sheet of spring steel in or on the actual electrode ring (3), wherein the sliding contact is in connection with a stationary sliding surface, to which the required high voltage is applied. The stationary sliding surface may, for example, be a component of the fastening ring.

With the exception of the electrode tips (5), the electrode ring (3) is an electrical insulator. The electrode ring (3) or the outer surface thereof generally consists of plastic. As with conventional prior art electrode rings, the internal diameter of the electrode ring is adapted to conventional high-speed rotary bells and is, for example, approximately 100 to 150 mm, while the external diameter thereof measured at the electrode tips (5) is, for example, approximately 250 to 300 mm. The electrode fingers (4) are for example 200 to 250 mm in length, form an angle of for example 10 to 20° relative to the axis of rotation of the electrode ring (3) and point in the direction of the object to be spray coated.

The above-described bearing connection permits the electrode ring (3) to perform rotational movements about the axis passing through the center of the circle thereof. By means of a suitable drive, the electrode ring (3) can be set in rotational movements about the axis passing through the center of the circle thereof and, during high-speed rotary application of spray coating, perform rotational movements about the common axis of rotation with the high-speed rotary bell, i.e., either rotation or oscillatory rotational movements in each case around the rotating high-speed rotary bell.

An example of types of drives with which the actual electrode ring (3) may be set in rotational movements about the axis passing through the center of the circle thereof is a mechanical drive, for example, by means of an electric motor or a pneumatically driven motor (for example a pneumatically controlled turbine with driving and braking air) via a drive belt, for example, toothed belt or a transmission, for example, a gear transmission. The drive means may here be components of the electrode ring and/or separate components.

When the electrode ring (3) rotates, the direction of rotation may be the same as or contrary to the direction of rotation of the high-speed rotary bell (1) and the rotational speed of the electrode ring during coating application is, for example, 10 to 100, preferably 15 to 75 revolutions per minute, wherein the rotational speed may preferably be modified steplessly, for example, adapted to the particular nature of the substrate to be coated. The direction of rotation of the electrode ring (3) during the coating operation may here remain unchanged or may alternate, for example, be alternated repeatedly.

In the case of oscillating rotational movements of the electrode ring (3), rotational movements periodically alternating in direction of rotation are performed, for example, with a frequency of alternation in the range from 0.5 to 2 Hz, wherein the individual rotational movements of the electrode ring (3) correspond to a deflection of the electrode ring (3) in the range of, for example, only 45 to 90°. In the case of oscillating rotational movements, the electrode ring (3) accordingly performs no complete rotations.

During high-speed rotational coating of an object, rotation and oscillating rotational movement of the electrode ring (3) may also alternate in any desired sequence over time, for example, also alternate repeatedly in succession. It may, for example, be convenient when coating large and simple areas of the surface (no or only slight curvatures with an up to infinite radius of curvature per unit of area) of an object to operate with a rotating electrode ring (3) and, when coating surface areas of complex topography (many and/or pronounced curvature with a small radius of curvature, corners, beads, edges per unit of area), to operate with an oscillating electrode ring (3).

In the process according to the invention, it is possible to use conventional high-speed rotary bells, known to the person skilled in the art, with spray edge diameters in the range of, for example, 40 to 70 mm and to operate them under conventional operating parameters. For example, rotational speeds of the bell are from 10,000 to 70,000 revolutions per minute, the shaping air throughput 60 to 1000 liters per minute and the coating flow rate 30 to 1200 ml per minute (for liquid spray coatings) or 50 to 300 g per minute (for powder spray coatings). The high voltage applied to the electrode tips (5) is also in the usual range of, for example, 40 to 100 kV.

Using the process according to the invention for the high-speed rotary application of powder or preferably liquid spray coatings, for example, spray coatings based on organic solvents or in particular aqueous spray coatings, it is possible to apply any conventional powder or liquid spray coatings known to the person skilled in the art and suitable for high-speed rotary application.

When using identical spray coatings, an identical high-speed rotary bell operated under likewise identical operating conditions and an identical electrode ring likewise operated under identical operating conditions but additionally performing rotational movements about the common axis of rotation with the high-speed rotary bell, the process according to the invention yields more uniform coating results with reduced electrode soiling. In comparison with the prior art process with a firmly fixed electrode ring which does not perform rotational movements, depending upon the coating task and object, improvements in the efficiency of application in the range of 3 to 10% in absolute terms (3 to 10 absolute-% less overspray) are, for example, achieved.

It is assumed that the rotation or the oscillating rotational movements of the electrode ring (3) apply a more homogeneous electrical field to the coating spray mist or powder coating spray cloud to be charged and, as a consequence, it is possible to achieve the advantageous effects in comparison with the prior art process.

The process according to the invention is in particular suitable for the original spray coating of industrially mass produced goods, such as for example automotive bodies and body parts. Spray application here generally proceeds with two or more high-speed rotary bells simultaneously, each being provided with an electrode ring according to the invention which is also driven according to the invention, which high-speed rotary bells are guided individually or also jointly as a group of two or more application devices over the surface of the object to be coated, in each case by means of an automatic device.

EXAMPLES

Example 1

According to the Invention

A 1 m by 1 m steel test panel coated with a cataphoretic primer, surfacer and flashed-off water-borne base coat was spray coated in a vertical position with a conventional commercial two-component polyurethane clear coat to a dry film thickness of 35 μm and, after flashing off for 5 minutes at 20° C., was baked for 30 minutes at 130° C. (object temperature).

The clear coat was applied by electrostatically assisted high-speed rotary application using the device shown in FIG. 1, wherein an electrode ring (3) was used which was rotatable about the common axis of the rotary bell and rotated with the high-speed rotary bell in the same direction as the rotary bell at 20 revolutions per minute during application of the clear coat.

The coating parameters were:

Flow rate of coating 250 ml/min,

Shaping air throughput 300 l/min,

Rotational speed of bell, 40000 revolutions per minute,

High voltage 90 kV.

Flow of the clear coat surface was determined by measuring its long and short wave waviness using a BYK-Gardner Wave-Scan instrument:

Long wave 12,

Short wave 4.

Example 2

Comparative Example

The same method was used as in Example 1 with the sole exception that, during application of the clear coat, the electrode ring remained firmly fixed around the high-speed rotary bell.

Flow of the clear coat surface was measured as in Example 1:

Long wave 16,

Short wave 7.

The flow achieved in Example 1 using the rotating electrodes provided improved flow of the clear coating as measured by wave scan in comparison to the prior art device of Example 2 in which the electrodes remained fixed during application of the clear coating.

What is claimed is:

1. An electrode ring suitable for providing electrostatic assistance to a high-speed rotary coating device for the application of spray coatings, the high-speed rotary coating device comprising a high-speed rotary bell, the electrode ring having electrode fingers connected thereto comprising electrode tips, wherein the electrode ring is connectable to the housing of the rotary bell of the high-speed rotary coating device with a fastening device by means of a bearing connection and the electrode ring is constructed so as to be capable of performing rotational movements about the axis of rotation of the rotary bell directed through the center of the circle of the electrode ring.

2. The electrode ring of claim 1, wherein the fastening device may be connected in a firmly fixed manner with the housing of the high-speed rotary bell such that the electrode ring surrounds the high-speed rotary bell located in the center thereof in an annular manner, wherein the high-speed rotary bell and electrode fingers of the electrode ring point in the same direction.

3. The electrode ring of claim 1, wherein the electrode ring comprises a sliding contact for the purpose of electrical contacting of the electrode tips.

4. An electrostatic coating device comprising a high-speed rotary bell having a central axis of rotation and having an electrode ring positioned around the central axis of the bell and connected to the housing of the bell with a fastening device and capable of performing rotational movements around the central axis of rotation of the bell and said electrode ring having electrode fingers attached thereto comprising electrode tips.

5. The electrostatic coating device of claim 4, wherein the electrode ring comprises a sliding contact for the purpose of electrical contacting of the electrode tips.

6. A process for coating substrates comprising coating a substrate by means of electrostatically assisted high-speed rotary application of spray coatings using a high-speed rotary coating device comprising a high-speed rotary bell, wherein the coatings are selected from the group consisting of powder coatings and liquid coatings, wherein an electrode ring used for external electrostatic charging of spray mist is positioned around the central axis of the bell, is connected to the housing of the bell with a fastening device, and is capable of performing rotational movements around the central axis of rotation of the bell, said electrode ring having electrode fingers attached thereto comprising electrode tips.

7. The process of claim 6, wherein the rotational movements of the electrode ring comprise rotational movements selected from the group consisting of rotation at 10 to 100 revolutions per minute, oscillating rotational movement with a frequency of alternation of 0.5 to 2 Hz and sequences of such rotations and oscillating rotational movements.

8. The process of claim 6, wherein the substrates comprise industrially mass produced goods.

* * * * *